US012178304B1

(12) United States Patent
Durity

(10) Patent No.: US 12,178,304 B1
(45) Date of Patent: Dec. 31, 2024

(54) DOME COMB APPARATUS

(71) Applicant: Noel Durity, Santa Ana, CA (US)

(72) Inventor: Noel Durity, Santa Ana, CA (US)

( * ) Notice: Subject to any disclaimer, the term of this patent is extended or adjusted under 35 U.S.C. 154(b) by 0 days.

(21) Appl. No.: 18/419,455

(22) Filed: Jan. 22, 2024

(51) Int. Cl.
*A45D 24/04* (2006.01)
*A45D 2/00* (2006.01)

(52) U.S. Cl.
CPC ..... *A45D 24/04* (2013.01); *A45D 2002/006* (2013.01)

(58) Field of Classification Search
CPC ..... A45D 24/00; A45D 24/04; A45D 24/08; A45D 24/22; A45D 2/00; A45D 2/002; A45D 2002/006; A46B 5/00; A46B 5/0041; A46B 5/007; A46B 5/02; A46B 5/021; A46B 5/029
See application file for complete search history.

(56) References Cited

U.S. PATENT DOCUMENTS

| | | | | |
|---|---|---|---|---|
| 4,500,939 | A * | 2/1985 | Gueret | A46B 15/0051 15/207.2 |
| 10,368,623 | B2 * | 8/2019 | Durity | A45D 2/00 |
| 10,799,006 | B2 | 10/2020 | Durity | |
| 11,607,024 | B1 | 3/2023 | Durity | |
| 2017/0231380 | A1 * | 8/2017 | Yang | B25G 1/06 132/121 |
| 2018/0146761 | A1 * | 5/2018 | Durity | A45D 2/00 |
| 2021/0127823 | A1 * | 5/2021 | Gaither | A46B 11/0065 |
| 2021/0153640 | A1 * | 5/2021 | Chen | A46B 17/06 |

* cited by examiner

*Primary Examiner* — Cris L. Rodriguez
*Assistant Examiner* — Karim Asqiriba
(74) *Attorney, Agent, or Firm* — John D. Tran; Rhema Law Group

(57) ABSTRACT

A dome comb system and method of manufacture can include: a dome body comprising: a dome peripheral support extending out from a dome inner surface toward a dome center, and a dome coupling element extending up from the bottom surface and along the dome outer surface; a locking ring comprising: a locking ring coupling element extending down from a locking ring top surface along the locking ring inner surface, and the dome coupling element together with the locking ring coupling element enabling the dome comb system to be in a coupled state or a decoupled state; and an insert comprising: a circular body, a screen.

20 Claims, 5 Drawing Sheets

DOME COMB APPARATUS

TECHNICAL FIELD

This disclosure relates to hair care industry more particularly to hair care products and methods related to styling and caring for African-American hair.

BACKGROUND

The African-American hair industry represents a quickly expanding and highly varied market. One notable trend beginning in the last decade of the twentieth century was a shift away from harsh and harmful chemicals towards more natural means.

Although much development and innovation has advanced this growing market segment a need still remains for an intuitive, easy to hold product for creating beautiful, long lasting, natural African-American hair coils, which cannot be achieved with prior developments.

Many prior developments are longitudinal and comb-like in configuration which have heating or steaming elements for retaining the curl. These products fail to provide adequate solutions to short naturally curly hair.

Other prior developments have included brushes and combs with various types and shapes of bristles and teeth. These developments largely work to separate hair strands rather than provide a compact twist or coil of hair.

Yet other prior developments have relied on rotating elements powered by electric motors implemented with electric cords or batteries. These devices, although specifically designed to be effective with African-American hair, are implemented with excessive costs, and mechanical complexities which have multiple potential failure points.

Still other prior developments contain a sponge or sponge like material. The sponges, however, can maintain moisture and become dirty resulting in unsanitary applications in a user's hair.

Solutions have been long sought but prior developments have not taught or suggested any complete solutions, and solutions to these problems have long eluded those skilled in the art. Thus, there remains a considerable need for devices and methods that provide an intuitive easy to hold product for creating beautiful, long lasting, natural African-American hair coils.

SUMMARY

A comb system and methods, providing an intuitive easy to hold product for creating beautiful, long lasting, natural African-American hair coils, are disclosed. The comb system and methods can include: a dome body comprising: a dome center, a dome inner surface, a dome outer surface, a dome bottom surface, a dome peripheral support extending out from the dome inner surface toward the dome center, and a dome coupling element extending up from the bottom surface and along the dome outer surface; a locking ring comprising: a locking ring center, a locking ring inner surface, a locking ring outer surface, a locking ring top surface, a locking ring coupling element extending down from the locking ring top surface along the locking ring inner surface, a locking ring inward extension extending toward the locking ring center, and the dome coupling element together with the locking ring coupling element enabling the dome comb system to be in a coupled state or a decoupled state; and an insert comprising: a circular body, a screen, and wherein the insert is configured to be positioned between the dome peripheral support and the locking ring inward extension with the circular body in direct contact with the dome peripheral support and the locking ring inner surface based on the dome comb system being in the coupled state, and the insert is configured to be changeable based on the dome comb system being in the decoupled state.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The dome comb system, hereinafter referred to as the comb system, is illustrated in the figures of the accompanying drawings which are meant to be exemplary and not limiting, in which like reference numerals are intended to refer to like components, and in which.

DETAILED DESCRIPTION

Figure 1:
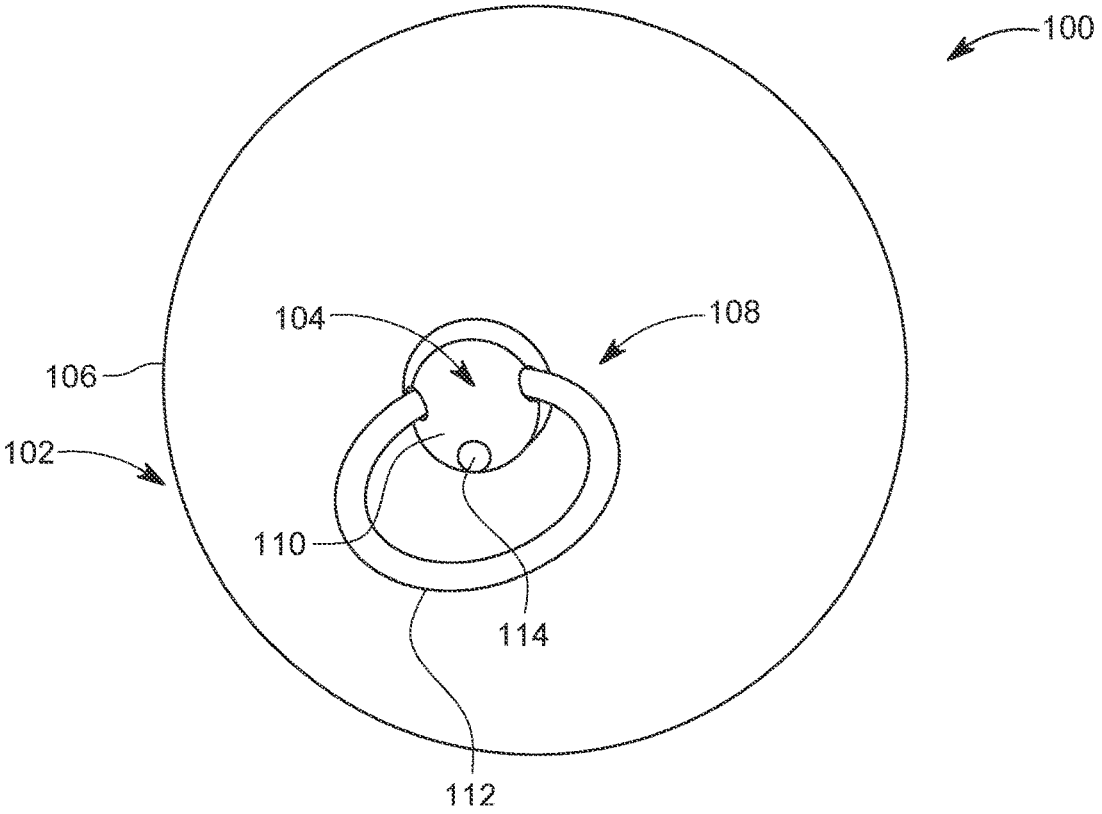
FIG. 1 is a top view of the comb system.

In the following description, reference is made to the accompanying drawings that form a part hereof, and in which are shown by way of illustration, embodiments in which the comb system may be practiced. It is to be understood that other embodiments may be utilized and structural changes may be made without departing from the scope of the comb system.

When features, aspects, or embodiments of the comb system are described in terms of steps of a process, an operation, a control flow, or a flow chart, it is to be understood that the steps can be combined, performed in a different order, deleted, or include additional steps without departing from the comb system as described herein.

The comb system is described in sufficient detail to enable those skilled in the art to make and use the comb system and provide numerous specific details to give a thorough understanding of the comb system; however, it will be apparent that the comb system may be practiced without these specific details.

In order to avoid obscuring the comb system, some well-known system configurations and descriptions are not disclosed in detail. Likewise, the drawings showing embodiments of the system are semi-diagrammatic and not to scale and, particularly, some of the dimensions are for the clarity of presentation and are shown greatly exaggerated in the drawing FIGS.

For expository purposes, the term "horizontal" as used herein is defined as a plane parallel to the bottom plane or surface of the dome bottom surface of the dome body, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane.

Referring now to FIG. 1, therein is shown a top view of the comb system 100. The comb system 100 is depicted and shown having a dome body 102 with a dome center 104.

The dome center 104 can be, for example, a geometric center of the dome body 102 when viewing the dome body 102 from the top.

The dome body 102 can be formed with a dome outer surface 106. The dome outer surface 106 can have a smooth flat finish and can have smooth transitions between various angles to ensure a comfortable secure grip.

The dome body 102 can further be formed with a handle 108 near the dome center 104 and directly contacting the dome outer surface 106. The handle 108 can be comprised of a handle fixture 110 and a handle grip 112. The handle fixture 110 can be integrally formed with the dome body 102 or can be affixed with an adhesive or mechanically with screws or other mechanical fastener 114.

The handle grip 112 can be a ring or other suitable shape for comfortable use. A ring has been discovered to increase the intuitive ease of use of the comb system 100 when combined with the smooth shape of the dome body 102.

Figure 2:
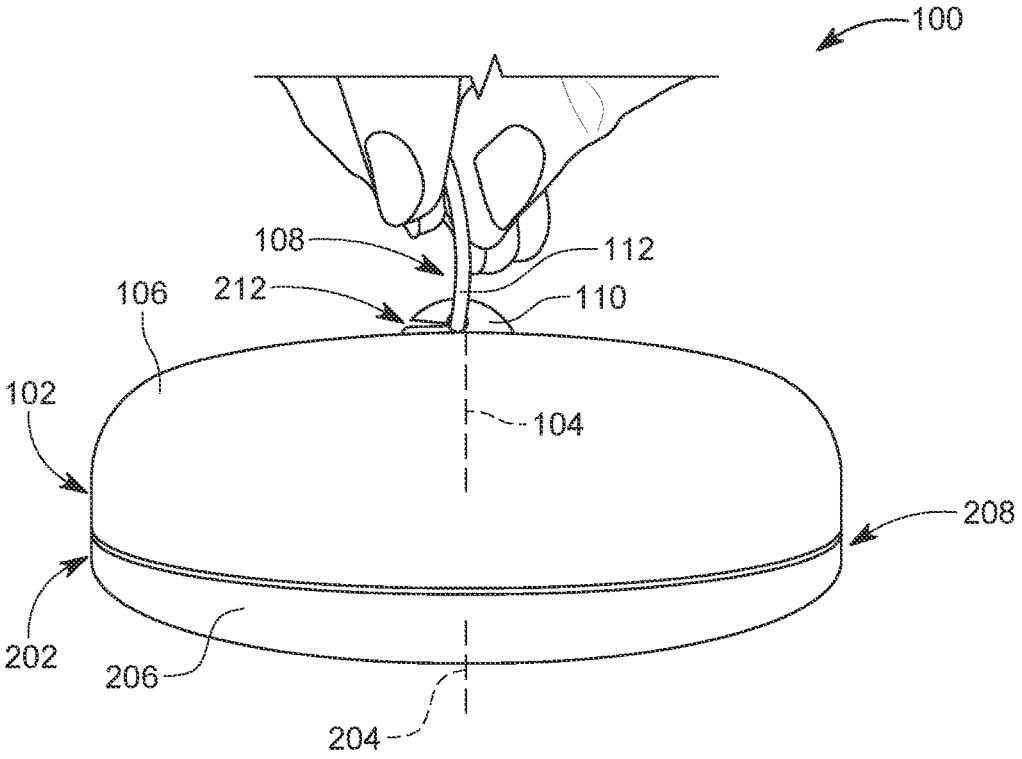
FIG. 2 is a side view of the comb system of FIG. 1 in a coupled state.

Referring now to FIG. 2, therein is shown a side view of the comb system 100 of FIG. 1 in a coupled state. The coupled state of the comb system 100 can include the dome body 102 coupled, locked, and affixed to a locking ring 202.

The locking ring 202 is shown and depicted with a locking ring center 204. The locking ring center 204 can be, for example, a geometric center of the locking ring 202 when viewing the locking ring 202 from the top.

The locking ring 202 can be formed with a locking ring outer surface 206. The locking ring outer surface 206 can have a smooth flat finish and can have smooth transitions between various angles to ensure a comfortable secure grip.

The dome outer surface 106 and the locking ring outer surface 206 can meet to form a flat surface 208. The flat surface 208 can be the surfaces of the dome outer surface 106 and the locking ring outer surface 206 forming a substantially flat surface with a space 210 between the dome body 102 and the locking ring 202.

The handle fixture 110 of the dome body 102 can include a slot 212 to allow the handle grip 112 to be removably mounted to the dome body 102. It is contemplated that the dome body 102 and the locking ring 202 can be made out of any rigid or semi-rigid material including: plastic, metal, wood, rubber, silicon, or a combination thereof.

Figure 3:
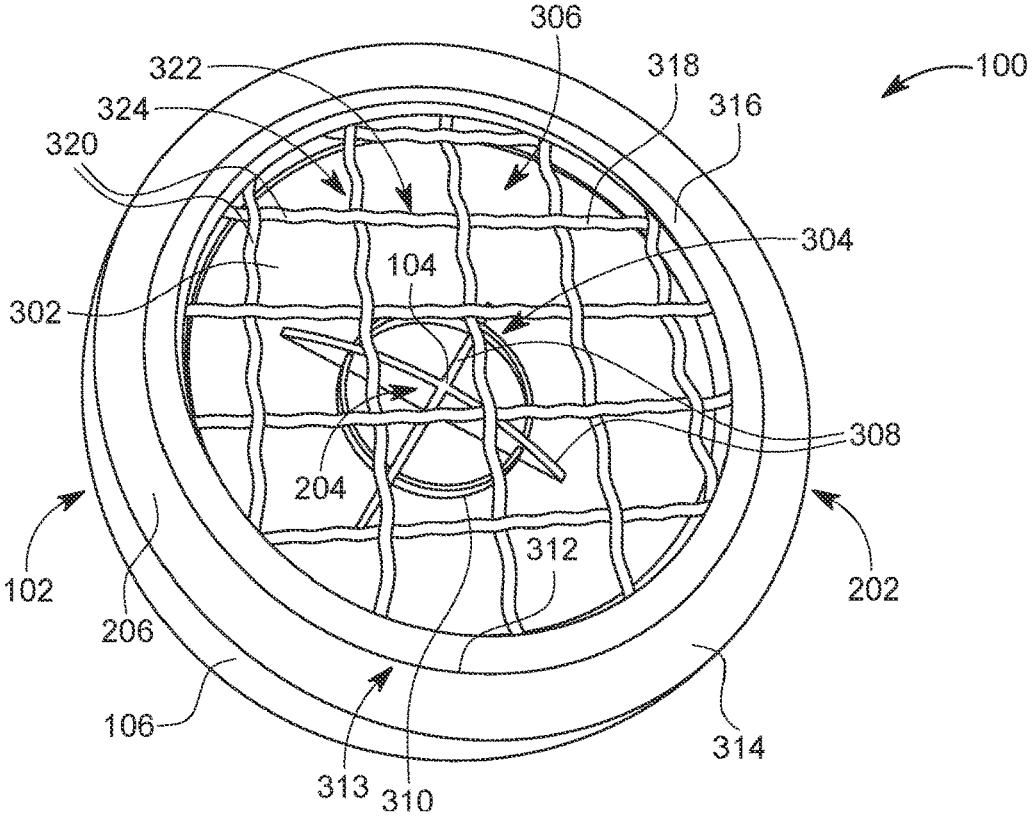
FIG. 3 is a bottom view of the comb system of FIG. 1.

Referring now to FIG. 3, therein is shown a bottom view of the comb system 100 of FIG. 1. The dome body 102 is shown from underneath to be formed with a dome inner surface 302 and a dome center support 304.

The dome inner surface 302 can be the surface covering the interior portions of the dome body 102. The dome center support 304 can extend from the dome inner surface 302 towards the locking ring 202 and towards an insert 306.

The dome center support 304 can include intersecting geometric shapes 308 and a peripheral ring 310. The intersecting geometric shapes 308 can provide a stand off height from the dome inner surface 302 for the insert 306.

Furthermore, the dome center support 304 can provide additional support for the insert 306 to prevent over flexing during use. The peripheral ring 310 can reinforce the intersecting geometric shapes 308 to provide additional structural rigidity.

The insert 306 is shown exposed from a locking ring opening surface 312. The locking ring opening surface 312 can circumscribe an opening 313 within the locking ring 202.

The locking ring 202 can include a locking ring inward extension 314 around the opening 313. The locking ring inward extension 314 partially covers and partially exposes the insert 306. That is, the locking ring inward extension 314 partially covers a circular body 316 of the insert 306.

The circular body 316 can also be exposed from the locking ring inward extension 314. The circular body 316 can be coupled to a screen 318.

The circular body 316 can circumscribe the screen 318 and provide rigidity for the screen 318 and provide anchorage for elongated members 320 of the screen 318. The elongated members 320 can be intersecting one another and can include wavy structures 322 in addition to woven structures 324.

The woven structures 324 can be understood as structures or shapes within the elongated members 320 formed when overlapping other elongated members 320. That is, the woven structures 324 are formed by the woven structure of the elongated members 320.

The wavy structures 322 are structures within the elongated members 320 that are wavy and are formed between woven interconnects of the elongated members 320. The wavy structures 322 provide enhanced structural rigidity to the screen 318 and provide extra purchase or grip for the screen 318 when in use with the hair of a user. The wavy structures 322 can penetrate and grip the hair to a greater degree than straight elongated members 320.

Figure 4:
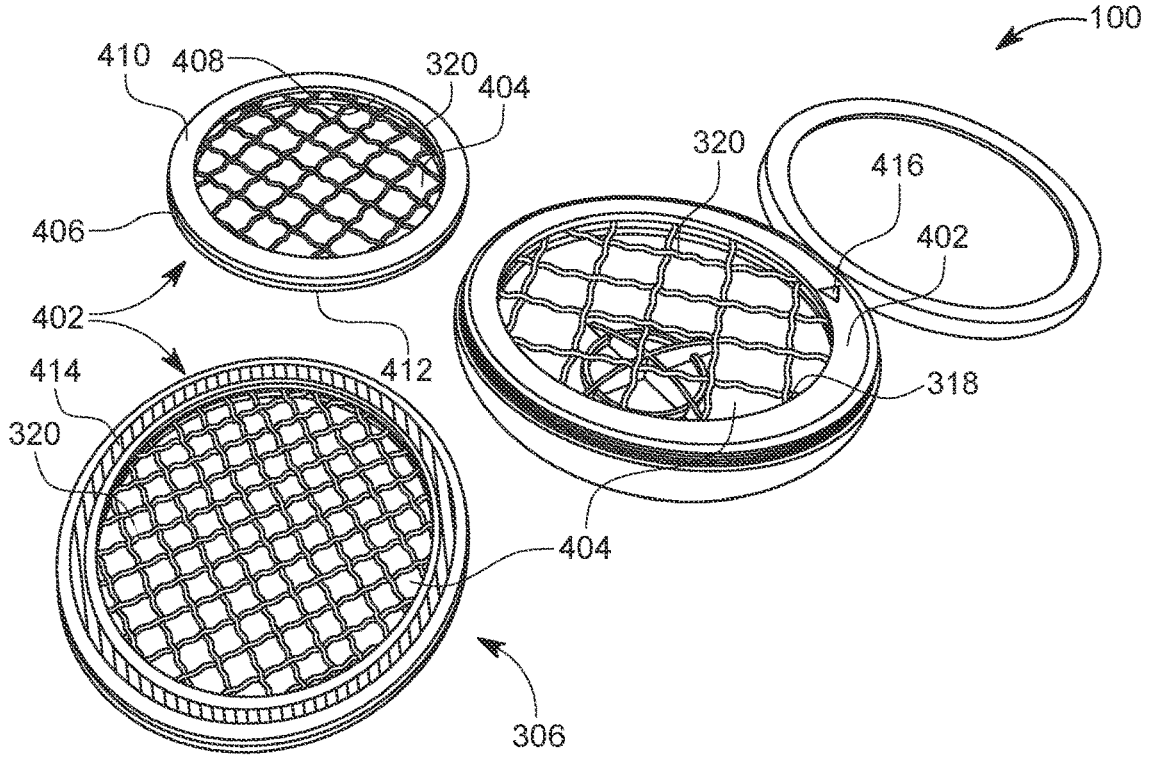
FIG. 4 is a bottom isometric view of the comb system with a plurality of inserts.

Referring now to FIG. 4, therein is shown a bottom isometric view of the comb system 100 with a plurality of inserts 402. The plurality of inserts 402 are each shown having the elongated members 320, and the plurality of inserts 402 each have different amounts of space 404 between the elongated members 320.

The inserts 306 are shown having the circular body 316 with an insert outer side 406, an insert inner side 408, an insert top side 410, and an insert bottom side 412. Some of the circular bodies 316 are shown with the insert top sides 410 and the insert bottom sides 412 having a textured surface 414, while others are depicted with a smooth surface 416.

The screen 318 can extend between the insert inner side 408. The insert inner side 408 extends above and below the screen 318.

Figure 5:
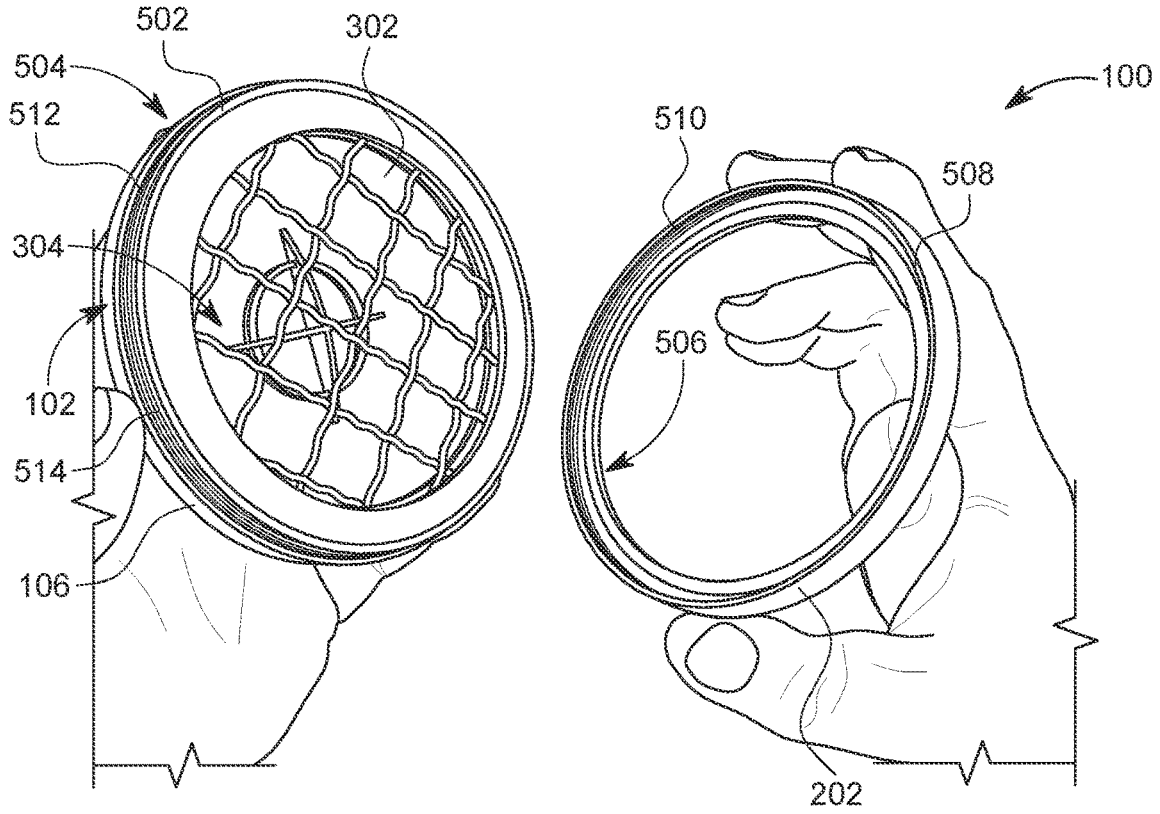
FIG. 5 is an exploded view of the comb system of FIG. 1 in a locking ring removal phase of operation and in a decoupled state.

Referring now to FIG. 5, therein is shown an exploded view of the comb system 100 of FIG. 1 in a locking ring removal phase of operation and in a decoupled state. The dome body 102 is shown disconnected and decoupled from the locking ring 202.

The dome body 102 is shown and depicted having a dome bottom surface 502. The dome bottom surface 502 can circumscribe the dome body 102 and connect the dome inner surface 302 to the dome outer surface 106.

The dome body 102 can include a dome coupling element 504 extending up from the dome bottom surface 502 and extending along the dome outer surface 106. The dome coupling element 504 can interface with the locking ring 202 to configure the comb system 100 in a coupled state.

The locking ring 202 can be seen to have a locking ring inner surface 506 and a locking ring top surface 508. The locking ring top surface 508 can face and be in direct contact with the dome bottom surface 502 when the comb system 100 is in the coupled state.

The locking ring inner surface 506 can include a locking ring coupling element 510 extending down from the locking ring top surface 508. The interface and mating of the dome coupling element 504 with the locking ring coupling element 510 can releasably couple and decouple the dome body 102 from the locking ring 202.

The locking ring coupling element 510 and the dome coupling element 504 are shown as threads but can be other locking elements such as quarter turn locks, brackets, or snapping elements. The dome center support 304 is shown extending in the direction of the dome bottom surface 502.

The locking ring top surface 508 can contact a dome overhang 512 extending laterally between the dome outer surface 106 and the dome coupling element 504. The dome overhang 512 can mirror the shape of the locking ring top surface 508 as these surfaces face one another when the comb system 100 is in the coupled state.

Between the dome coupling element 504 and the dome bottom surface 502 the dome body 102 can include an angled surface which can make the mating and coupling between the dome body 102 and the locking ring 202 easier. The insert 306 is shown seated within the dome body 102 and extending past the dome bottom surface 502.

Figure 6:
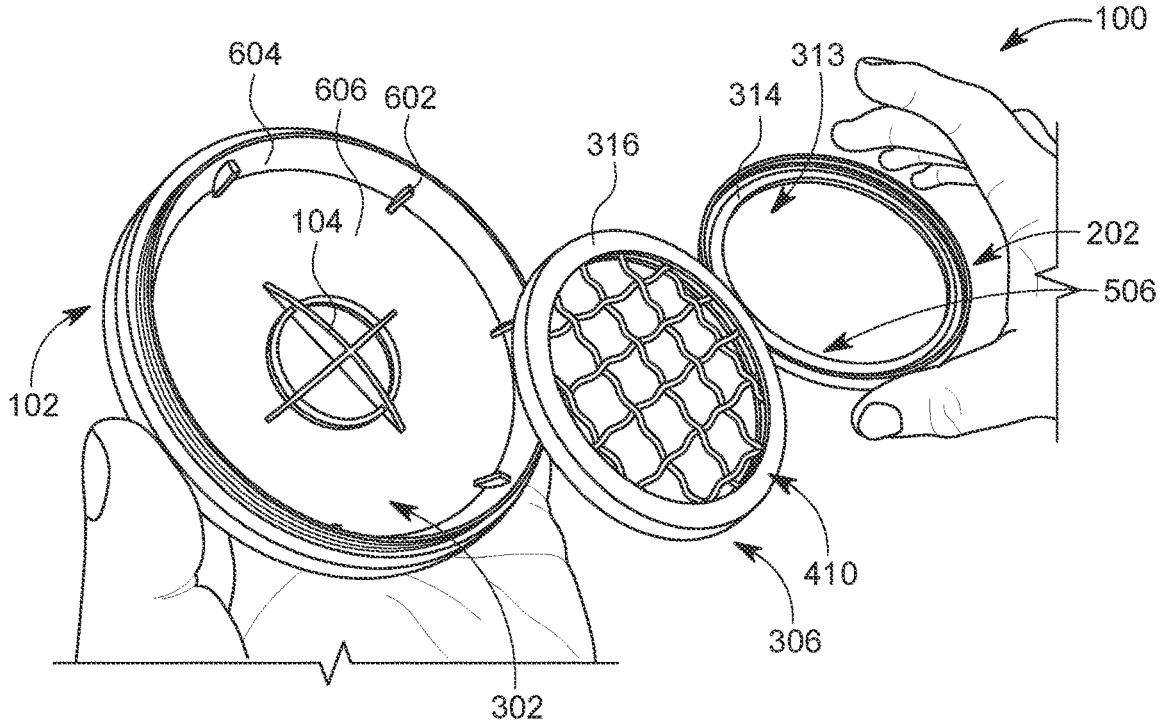
FIG. 6 is an exploded view of the comb system of FIG. 1 in an insert removal phase of operation.

Referring now to FIG. 6, therein is shown an exploded view of the comb system 100 of FIG. 1 in an insert removal phase of operation. The insert 306 is shown removed from between the dome body 102 and the locking ring 202.

The dome body 102 is shown having dome peripheral supports 602 extending out from the dome inner surface 302 toward the dome center 104. The insert 306 is also shown, for example in FIG. 5, fitting within a vertical side 604 created by the dome inner surface 302 below the dome peripheral supports 602.

The circular body 316 is formed to have a snug friction fit against the vertical side 604. The height of the vertical side 604 between the dome peripheral supports 602 and the dome bottom surface 502 can be less than a width of the circular body 316 in order to provide a compression on the circular body 316 with the dome peripheral supports 602 and the locking ring inward extension 314 of FIG. 3.

The dome peripheral supports 602 extend from the dome inner surface 302 towards the dome center 104 a distance that is less than a width of the insert top side 410 and less than a length of the locking ring inward extension 314. This ensures the dome peripheral supports 602 do not extend into the opening 313 where they can be seen by a user while the comb system 100 is in the coupled state.

The insert 306 is shown and configured throughout the FIGS. 1-6 to be positioned between the dome peripheral supports 602 and the locking ring inward extension 314 with the circular body 316 in direct contact with the dome peripheral supports 602 and the locking ring inner surface 506 of the locking ring inward extension 314, based on the comb system 100 being in the coupled state; and the insert 306 is shown and configured to be changeable based on the dome comb system 100 being in the decoupled state.

Figure 7:
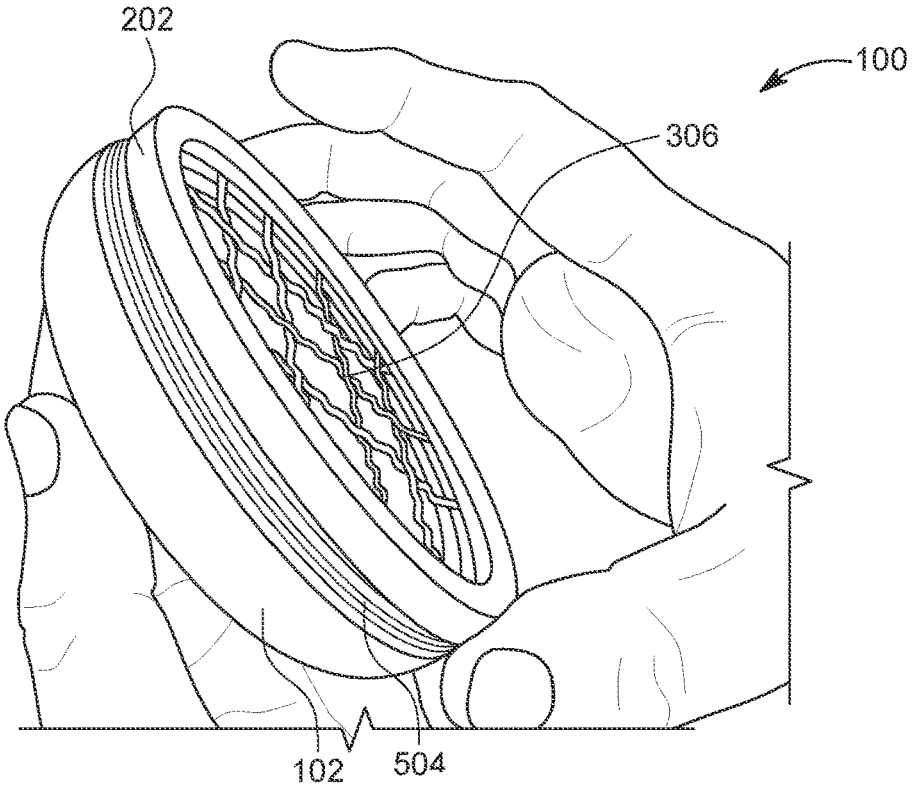
FIG. 7 is a side view of the comb system in a locking ring attachment phase of operation.

Referring now to FIG. 7, therein is shown a side view of the comb system 100 in a locking ring attachment phase of operation. The locking ring coupling element 510 of FIG. 5 is mated with the dome coupling element 504.

Mating the dome body 102 with the locking ring 202 will place the comb system 100 into the coupled state. In the coupled state, the insert 306 is held securely in place with a friction fit between the dome body 102 and the locking ring 202.

Figure 8:
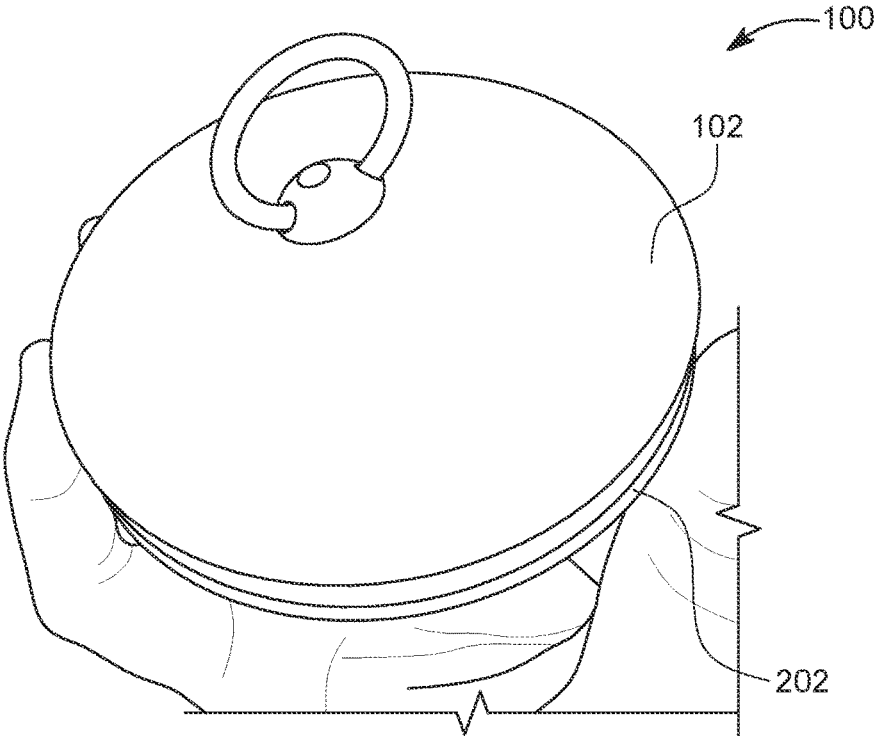
FIG. 8 is a top isometric view of the comb system of FIG. 1.

Referring now to FIG. 8, therein is shown a top isometric view of the comb system 100 of FIG. 1. The dome body 102 and the locking ring 202 combine to form an aesthetically pleasing and ergonomically comfortable comb system 100. The comb system 100 provides a simple, durable, portable, and washable comb system 100, which is intuitively useful for creating beautiful, long lasting, natural African-American hair coils.

Figure 9:
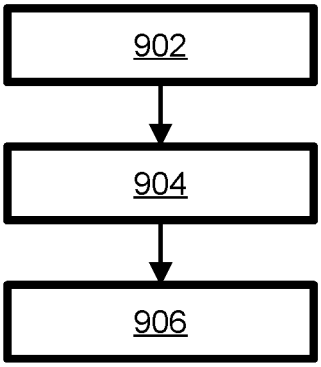
FIG. 9 is a method of manufacturing the comb system of FIG. 1.

Referring now to FIG. 9, therein is shown a method of manufacturing the comb system 100 of FIG. 1. The method can include forming a dome body comprising: a dome center, a dome inner surface, a dome outer surface, a dome bottom surface, a dome peripheral support extending out from the dome inner surface toward the dome center, and a dome coupling element extending up from the bottom surface and along the dome outer surface in a block 902; forming a locking ring comprising: a locking ring center, a locking ring inner surface, a locking ring outer surface, a locking ring top surface, a locking ring coupling element extending down from the locking ring top surface along the locking ring inner surface, a locking ring inward extension extending toward the locking ring center, and the dome coupling element together with the locking ring coupling element enabling the dome comb system to be in a coupled state or a decoupled state in a block 904; and forming an insert comprising: a circular body, a screen, and wherein the insert is configured to be positioned between the dome peripheral support and the locking ring inward extension with the circular body in direct contact with the dome peripheral support and the locking ring inner surface based on the dome comb system being in the coupled state, and the insert is configured to be changeable based on the dome comb system being in the decoupled state in a block 906.

Thus, it has been discovered that the comb system furnishes important and heretofore unknown and unavailable solutions, abilities, and functional aspects. The resulting configurations provide an intuitive easy to hold product for creating beautiful, long lasting, natural African-American hair coils and are straightforward, cost-effective, uncomplicated, highly versatile, accurate, sensitive, and effective, and can be implemented by adapting known components for ready, efficient, and economical manufacturing, application, and utilization.

While the comb system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A dome comb system comprising:

a dome body comprising:

a dome center, a dome inner surface, a dome outer surface, a dome bottom surface, a dome peripheral support extending out from the dome inner surface toward the dome center, and a dome coupling element extending up from the bottom surface and along the dome outer surface;

a locking ring comprising:

a locking ring center, a locking ring inner surface, a locking ring outer surface, a locking ring top surface, a locking ring coupling element extending down from the locking ring top surface along the locking ring inner surface, a locking ring inward extension extending toward the locking ring center, and the dome coupling element together with the locking ring coupling element enabling the dome comb system to be in a coupled state or a decoupled state; and an insert comprising:

a circular body, a screen, and wherein the insert is configured to be positioned between the dome peripheral support and the locking ring inward extension with the circular body in direct contact with the dome peripheral support and the locking ring inner surface based on the dome comb system being in the coupled state, and the insert is configured to be changeable based on the dome comb system being in the decoupled state.

2. The dome comb system of claim 1, wherein the insert fits within a vertical side created by the dome inner surface.

3. The dome comb system of claim 1, wherein the dome coupling element and the locking ring coupling element are threads.

4. The dome comb system of claim 1, wherein the locking ring inward extension partially covers and partially exposes the circular body based on the dome comb system being in the coupled state.

5. The dome comb system of claim 1, wherein the dome outer surface and the locking ring outer surface meet to form a flat surface.

6. A dome comb system comprising:

a dome body comprising:

a dome center, a dome inner surface, a dome outer surface, a dome bottom surface, a dome peripheral support extending out from the dome inner surface toward the dome center, a dome coupling element extending up from the bottom surface and along the dome outer surface, and a handle including a handle fixture on the dome outer surface extending away from the dome bottom surface and including a handle grip pivotally attached to the handle fixture, a locking ring comprising:

a locking ring center, a locking ring inner surface, a locking ring outer surface, a locking ring top surface, a locking ring coupling element extending down from the locking ring top surface along the locking ring inner surface, a locking ring inward extension extending toward the locking ring center, and the dome coupling element together with the locking ring coupling element enabling the dome comb system to be in a coupled state or a decoupled state; and an insert comprising:

a circular body, a screen, and wherein the insert is configured to be positioned between the dome peripheral support and the locking ring inward extension with the circular body in direct contact with the dome peripheral support and the locking ring inner surface based on the dome comb system being in the coupled state, and the insert is configured to be changeable based on the dome comb system being in the decoupled state.

7. The dome comb system of claim 6, wherein the handle is a ring.

8. The dome comb system of claim 6, wherein the screen includes intersecting elongated members with a wavy structure in addition to a woven structure.

9. The dome comb system of claim 6, wherein the insert is one of a plurality of inserts, each of the plurality of inserts having intersecting elongated members, and the plurality of inserts having different amounts of space between the intersecting elongated members.

10. The dome comb system of claim 6, wherein the handle fixture includes a slot to allow the handle grip to be removably mounted to the dome body.

11. A method of manufacturing a dome comb system comprising:

forming a dome body comprising:

a dome center, a dome inner surface, a dome outer surface, a dome bottom surface, a dome peripheral support extending out from the dome inner surface toward the dome center, and a dome coupling element extending up from the bottom surface and along the dome outer surface;

forming a locking ring comprising:

a locking ring center, a locking ring inner surface, a locking ring outer surface, a locking ring top surface, a locking ring coupling element extending down from the locking ring top surface along the locking ring inner surface, a locking ring inward extension extending toward the locking ring center, and the dome coupling element together with the locking ring coupling element enabling the dome comb system to be in a coupled state or a decoupled state; and forming an insert comprising:

a circular body, a screen, and wherein the insert is configured to be positioned between the dome peripheral support and the locking ring inward extension with the circular body in direct contact with the dome peripheral support and the locking ring inner surface based on the dome comb system being in the coupled state, and the insert is configured to be changeable based on the dome comb system being in the decoupled state.

12. The method of manufacturing the dome comb system of claim 11, wherein forming the insert includes forming the insert to fit within a vertical side created by the dome inner surface.

13. The method of manufacturing the dome comb system of claim 11, wherein forming the dome body includes forming the dome coupling element as threads; and forming the locking ring includes forming the locking ring coupling element as threads.

14. The method of manufacturing the dome comb system of claim 11, wherein forming the locking ring includes forming the locking ring inward extension configured to partially cover and partially expose the circular body based on the dome comb system being in the coupled state.

15. The method of manufacturing the dome comb system of claim 11, wherein forming the dome body and forming the locking ring includes forming the dome outer surface and forming the locking ring outer surface meet to form a flat surface.

16. The method of manufacturing the dome comb system of claim 11, further comprising: forming a handle including a handle fixture on the dome outer surface extending away from the dome bottom surface, and a handle grip pivotally attached to the handle fixture.

17. The method of manufacturing the dome comb system of claim 16, wherein forming the handle includes forming the handle grip as a ring.

18. The method of manufacturing the dome comb system of claim 16, wherein forming the insert includes forming the screen having intersecting elongated members with a wavy structure in addition to a woven structure.

19. The method of manufacturing the dome comb system of claim 16, wherein forming the insert includes forming a plurality of inserts, each of the plurality of inserts having intersecting elongated members, and the plurality of inserts having different amounts of space between the intersecting elongated members.

20. The method of manufacturing the dome comb system of claim 16, wherein forming the handle includes forming the handle fixture including a slot to allow the handle grip to be removably mounted to the dome body.

* * * * *